US008025478B2

(12) United States Patent
Grimm et al.

(10) Patent No.: US 8,025,478 B2
(45) Date of Patent: Sep. 27, 2011

(54) CENTRIFUGAL PUMP

(75) Inventors: Michel Grimm, St.-Blaise (CH); Jean-Nicolas Favre, Cressier (CH); Hagen Renger, Bochum (DE)

(73) Assignee: Egger Pumps Technology AG (CH)

( * ) Notice: Subject to any disclaimer, the term of this patent is extended or adjusted under 35 U.S.C. 154(b) by 870 days.

(21) Appl. No.: 11/917,440

(22) PCT Filed: Jun. 16, 2005

(86) PCT No.: PCT/CH2005/000337

§ 371 (c)(1),
(2), (4) Date: Mar. 10, 2008

(87) PCT Pub. No.: WO2006/133577

PCT Pub. Date: Dec. 21, 2006

(65) Prior Publication Data

US 2009/0324402 A1 Dec. 31, 2009

(51) Int. Cl.
*F04D 29/22* (2006.01)
*F01D 5/14* (2006.01)

(52) U.S. Cl. ..... 415/206; 415/71; 415/204; 416/182; 416/185; 416/186 R; 416/187; 416/176

(58) Field of Classification Search ..... 416/176, 416/182, 185, 186 R, 187, 188; 415/71, 415/204, 206

See application file for complete search history.

(56) References Cited

U.S. PATENT DOCUMENTS

| | | | | |
|---|---|---|---|---|
| 2,272,469 | A | 2/1942 | Lannert | |
| 3,130,678 | A | 4/1964 | Chenault | |
| 4,347,035 | A | 8/1982 | Stahle | 415/121 |
| 4,475,868 | A * | 10/1984 | Renger | 415/225 |
| 4,592,700 | A * | 6/1986 | Toguchi et al. | 415/225 |
| 5,104,541 | A * | 4/1992 | Daniel | 210/512.3 |
| 2004/0234370 | A1 * | 11/2004 | Simakaski et al. | 415/121.1 |
| 2005/0095124 | A1 | 5/2005 | Arnold et al. | 415/174.4 |

FOREIGN PATENT DOCUMENTS

CH 660 511 4/1987

OTHER PUBLICATIONS

PCT International Search Report & Written Opinion dated Sep. 28, 2005 issued in corresponding PCT International Appln. No. PCT/CH2005/000337 filed Jun. 16, 2005.

* cited by examiner

*Primary Examiner* — Ninh H Nguyen
*Assistant Examiner* — Liam McDowell
(74) *Attorney, Agent, or Firm* — Ostrolenk Faber LLP

(57) ABSTRACT

An impeller plate of an impeller of a centrifugal pump, particularly a channel impeller pump, for pumping liquids with solid or gaseous admixtures, is provided with at least one wide vane that is displaced toward the impeller drive by a distance D so that the impeller chamber is enlarged by a rearward portion thereof. In addition, the impeller comprises at least one auxiliary vane having a center width at between 25%-75% of the width of the wide vane. This arrangement improves particularly the gas transporting ability of the pump.

18 Claims, 4 Drawing Sheets

CENTRIFUGAL PUMP

BACKGROUND OF THE INVENTION

The present invention refers to a centrifugal pump for pumping liquids with solid or gaseous admixtures, more particularly a channel impeller pump, and particularly concerns the impeller and the chamber in which it rotates.

CROSS-REFERENCE TO RELATED APPLICATION

The present application is a 35 U.S.C. §§371 national phase conversion of PCT/CH2005/000337, filed Jun. 16, 2005. The PCT International Application was published in the German language.

In known pumps of this type, the cross-sections of the channels between the vanes of the impeller are designed so as to allow the passage of relatively large solid bodies. This implies a construction where the channel impellers generally comprise only 1 to 3 vanes. Channel impeller pumps are successfully used for pumping liquids that are charged with thick matter, sludge, slags, etc. Their ability to expel gaseous accumulations (including air), however, is limited as in other centrifugal pumps too.

The underlying aim of the invention is to provide a centrifugal pump whose ability to expel gaseous accumulations is significantly improved.

Centrifugal pumps or channel impeller pumps having satisfactory specific characteristics for solving this problem are not known to the inventor.

Since this class of pumps is not comparable to free-flow pumps on account of their different operating modes, measures for modifying their properties are generally not transferable from one to another.

A free-flow pump has an impeller chamber in which an impeller is arranged and a vortex chamber that extends in front of the impeller chamber and is not swept by the vanes.

The liquid enters into the vane channels axially from the front side of the impeller near the hub thereof, moves outwards on an arc of nearly 180°,and leaves the impeller again in its outer area in an axial, however opposite direction on the front side thereof. The exiting liquid sets the liquid mass in the vortex chamber into rotation by pulse transmission. As described in DE 34 08 810 C2,individual wider vanes are used in order to improve the coupling effect with the liquid mass in the vortex chamber. Due to the path that the liquid follows through the impeller, an enlargement of the vanes, which must be kept within certain limits in any case, also amounts to a lengthening of the vanes as measured along the flow path.

The centrifugal pump, more particularly channel impeller pump, that is known per se in the prior art, has an impeller chamber in which an impeller is arranged but, in contrast to free-flow pumps, has no vortex chamber.

In a known manner, the ability to expel gas inclusions with the liquid increases with the flow velocity and the flow turbulence of the medium along its way through the pump. In other words, an increase of this velocity might therefore constitute an apparent possible solution to the encountered problem. In view of the fact that solids have to be transported along with the liquid, and of the resulting constructive requirements, the approach using an increased flow velocity proves unpractical.

Only through numerous and varied tests was it finally discovered that the ejection of gaseous admixtures in the liquid is sensibly improved by several features. The impeller plate, which supports the vanes, is set back or rearward more than in prior art pumps and extends into a rearward impeller chamber that has a volume corresponding to the distance to the rear. The forward impeller chamber receives the front region of the impeller. Also, the objective is achieved without a reduction of the free passage, which is an indispensable general condition as it is required to pump the solids contained in the liquid.

On this basis, the features defined in the dependent claims represent particularly advantageous embodiments of the invention since they produced even better results with regard to the problematic gas transport and ultimately to the general efficiency.

BRIEF DESCRIPTION OF THE DRAWINGS

Flow phenomena, particularly those taking place in centrifugal pumps, can often only be detected empirically and are barely reproducible or comprehensible mathematically and physically. The interior of the correspondingly redesigned casing of the centrifugal pump of the invention is now comprised of a forward cavity and of a rearward cavity separated from the former by a virtual plane. The forward cavity that forms the original impeller chamber holds the forward portion(s) of the vane(s) while the impeller plate and the rear portion(s) of the vane(s) connected thereto are accommodated in the rearward cavity. It can be assumed that due to this novel arrangement of the impeller and the resulting chamber differentiation and enlargement, the centrifugal effect produced in the forward chamber extending between the liquid entrance and its exit is destroyed, i.e. the formation of a liquid ring inside which gas accumulates and which prevents a further continuous entry of the liquid to be conveyed, while a certain vortex or turbulence is formed instead. Furthermore, due to a slow flow-through velocity, it is believed that there is probably a flow breakaway on the suction side of the vanes. Finally, the pump of the invention is characterized by an even higher efficiency as compared to prior art pumps for media containing gases.

The results could be further improved by providing the impeller with auxiliary vanes in addition to the regular vanes. The auxiliary vanes have an axial width of about 25% to 75% of the center width of the regular vanes. Here, in fact, the liquid molecules and the solids will impinge on the leading edge(s) of the auxiliary vane(s) while it is noted that the advantage resulting from the improved gas distribution that is achieved outweighs the disadvantage incurred by the frictional forces produced by the additional friction surfaces of the auxiliary vanes by far.

Three preferred exemplary embodiments of the invention will be described in more detail hereinafter with reference to the drawing. Schematically.

DESCRIPTION OF PREFERRED EMBODIMENTS

Figure 1:
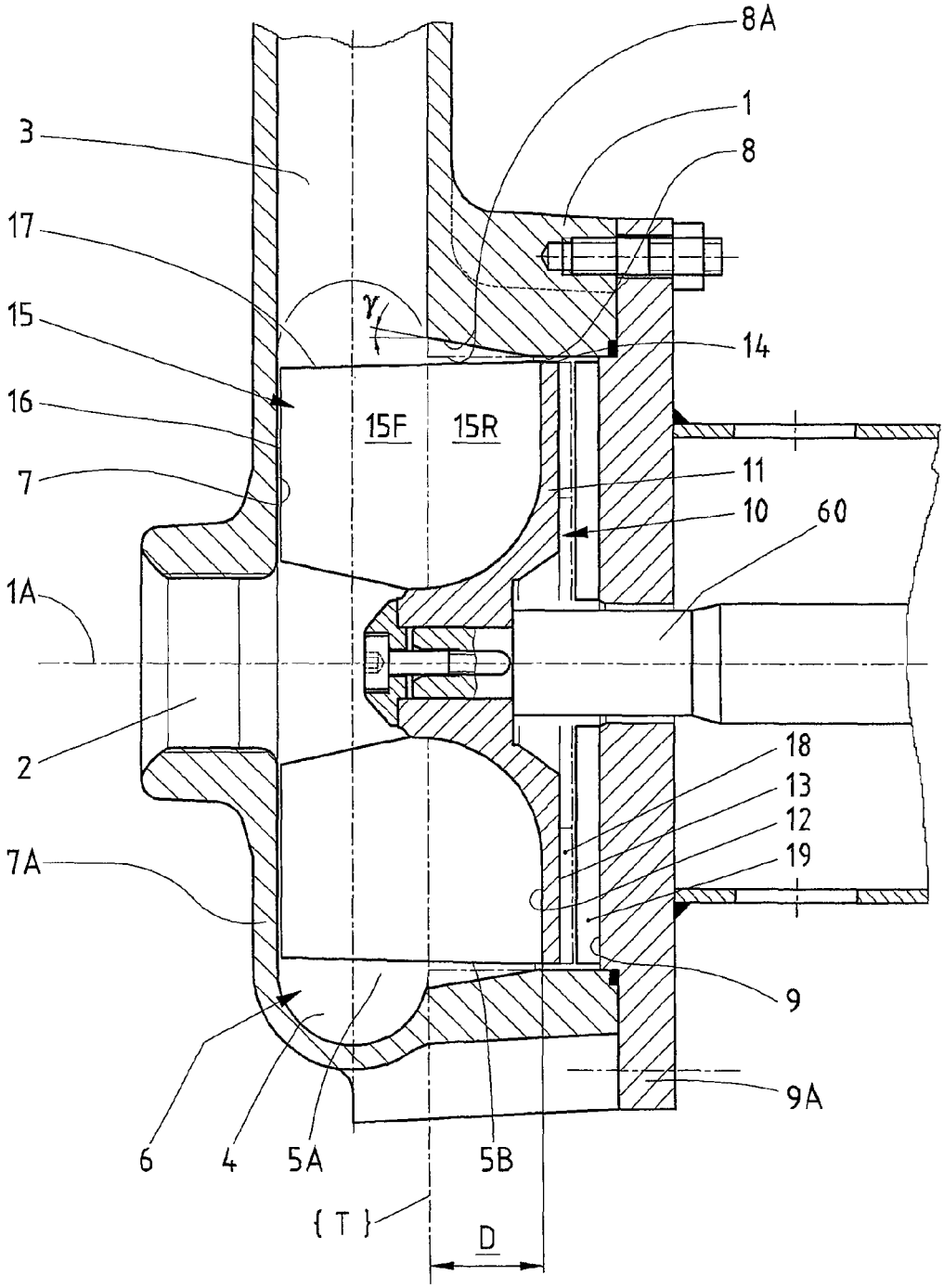
FIG. 1 shows a sectional view of a first embodiment of the channel impeller, or centrifugal pump of the invention.

As shown in FIG. 1, an impeller 10 is enclosed in a casing 1 having a liquid entrance 2 and exit 3, i.e. an intake and an outlet opening. Impeller 10 is fastened to a shaft 60 that is drivable by a non-represented motor. Casing 1, impeller 10, and shaft 60 have a common symmetry axis 1A. The interior 6 of casing 1 is comprised of a forward cavity 5A comprising a collecting chamber 4 that extends in the form of an annular space or spiral, and a rearward cavity 5B separated therefrom by a virtual plane {T} . This plane {T} approximately coincides with the (non-referenced) plane that contains the (also non-referenced) generating line of opening 3 and extends orthogonally to symmetry axis 1A.

Impeller 10 comprises an impeller plate 11 carrying preferably curved vanes 15 whose number is determined according to the size of the solids, and having a forward 12 and a rearward surface 13. Generally, as mentioned above, one to three vanes are provided (see also FIG. 3). Forward portion 15F and rearward portion 15R of vane(s) 15 extend in forward chamber portion 5A and in rearward chamber portion 5B of casing 1, respectively. Forward edge 16 of vane 15 may move in immediate proximity past the inner surface 7 of casing wall portion 7A extending around the inlet. Due to this proximity, a certain sealing effect is achieved as the distance between the mentioned surface and the mentioned forward edge is of the order of tenths of millimeters and generally smaller than 0.5 mm. Peripheral edge 17 of forward portion 15F of vanes 15 may pass near liquid exit 3. A rotation-symmetrical casing surface 8, 8A of casing 1, which surface is defined depending on the particular construction of the pump, encompasses impeller plate 11 in a preferably tight manner (i.e. in the order of some millimeters), i.e. the peripheral surface 14 thereof and the peripheral edges 17 of vanes 15, respectively of rearward portions 15R of these vanes, which in the example are flush with that surface. In the embodiment illustrated in FIG. 1, surface of revolution 8 extending around impeller plate 11 is cylindrical, whereas surface of revolution 8A is e.g. cylindrical (in FIG. 1, this contour is merely symbolized by a dotted line) or conical with a cone angle of $2\gamma$, the angle $\gamma$ preferably being $\leqq$ (smaller than or equal to) 20°. The choice of the impeller construction, more particularly of peripheral edges 17 and of peripheral surface 14, is determined in view of the specific rotation speed $n_q$ in a manner known to those skilled in the art.

In the conventional centrifugal or channel impeller pumps, the impeller plate is arranged such that its front surface is located at least approximately in the virtual plane {T} while the vanes extend entirely in the impeller chamber that is situated in front of this plane {T}. Now, in contrast to these pumps of the prior art, surface 12 of impeller plate 11 is rearwardly displaced, i.e. toward the drive, by a distance D while the vanes are enlarged by this distance (portion 15R of the vanes) and the original impeller chamber 5A is enlarged by an additional impeller chamber portion 5B having a volume that corresponds to the distance D. The tests have shown that the distance D should be comprised within a range of 25% to 75% of the total axial direction width of vanes 15, preferably approx. 50% of the mentioned total width.

Rearward surface 13 of impeller plate 11 may be located in immediate proximity of surface 9 of rear wall 9A of casing 1. According to a variant, however, a larger distance may be left between surfaces 13, 9 in order to make room for ridges 18 (on surface 13) or 19 (on surface 9) provided on one and/or the other of these surfaces. Ridges 18 that are known in the art per se may be curved radially or e.g. similarly to vanes 15 (see FIG. 3, reference numeral 23). Ridges 19 that are not known in the art, in contrast, preferably extend radially and fulfill the function of a swirl brake, prevent a centrifuge effect, and thus ensure a better gas flow.

Figure 2:
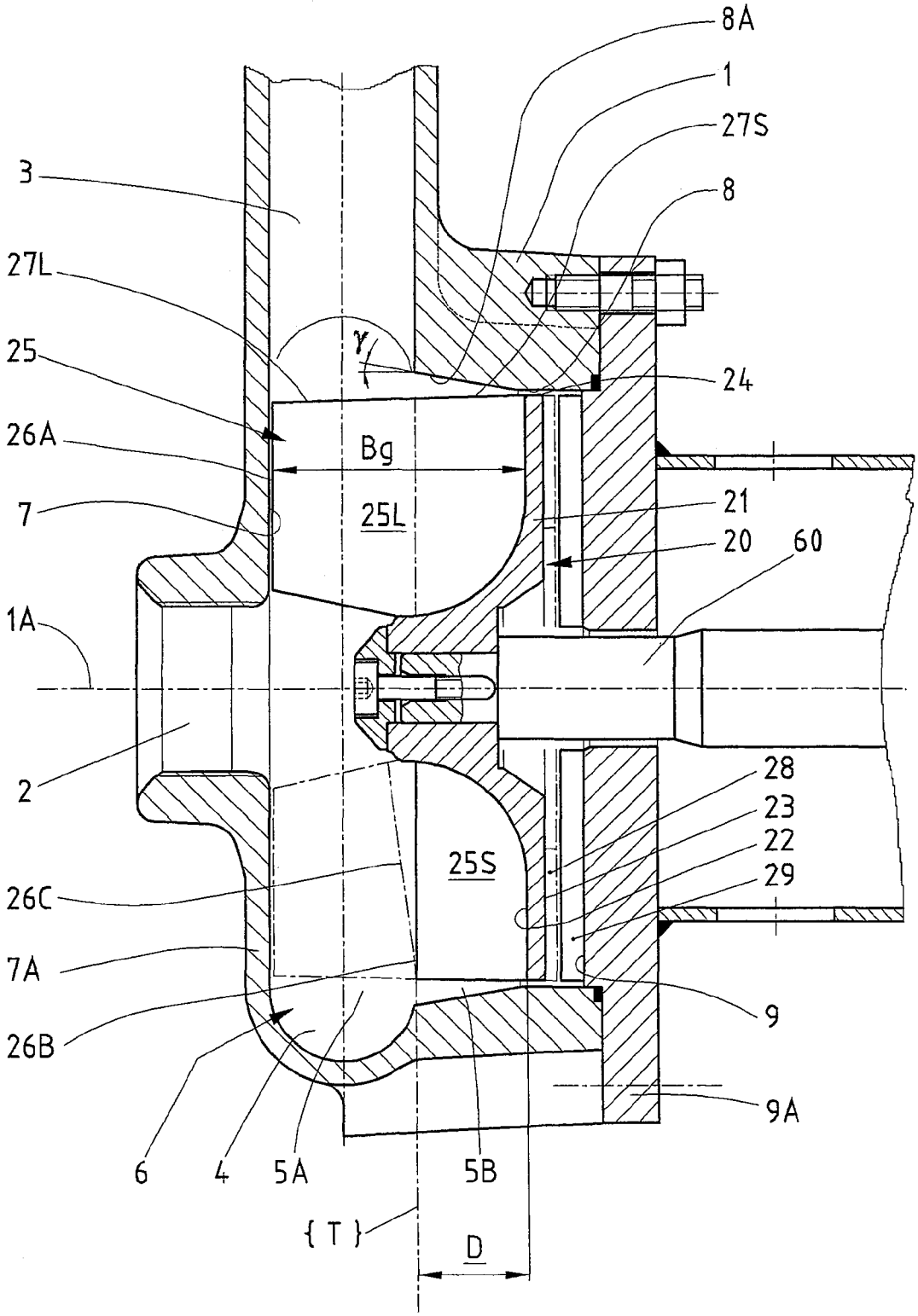
FIG. 2 shows a sectional view of a second embodiment of this pump.

In FIG. 2, a second embodiment is illustrated which, in comparison to the first or basic embodiment described above, comprises the same casing 1 but has an impeller 20 that is driven via shaft 60 and whose impeller plate 21 is provided with a vane system 25. On one hand, this vane system consists of at least one vane 25L that is identical to vane 15 or at least similar in width and whose forward edge 26A is arranged to move in immediate proximity past inner surface 7 of forward wall portion 7A of casing 1, and on the other hand, additionally of at least one narrower, preferably curved auxiliary vane 25S that extends at least partially in the rearward impeller chamber 5B. This means that forward edge 26B of this auxiliary vane 25S may be located in virtual plane {T} or in a plane that is situated in immediate proximity to this plane {T}. The latter may be flat and parallel or inclined with respect to plane {T}, or curved. In other words, edges 26B may be orthogonal to symmetry axis 1A or may have another shape and may e.g. rise outwardly or inwardly (by way of illustration, dotted line 26C shows a possible tapering shape of the forward edge of auxiliary vanes 25S).

The distance D between forward surface 22 of impeller plate 21 and forward edge 26B, which corresponds to the axial direction width (or center width, determined on half of the radius of the impeller plate approximately) of auxiliary vanes 25S, should be comprised within a range of 25% to 75% of the total width Bg of wide vanes 25L, preferably 50% of that total width, so that vanes 25S essentially extend in rearward impeller chamber 5B only.

Figure 3:
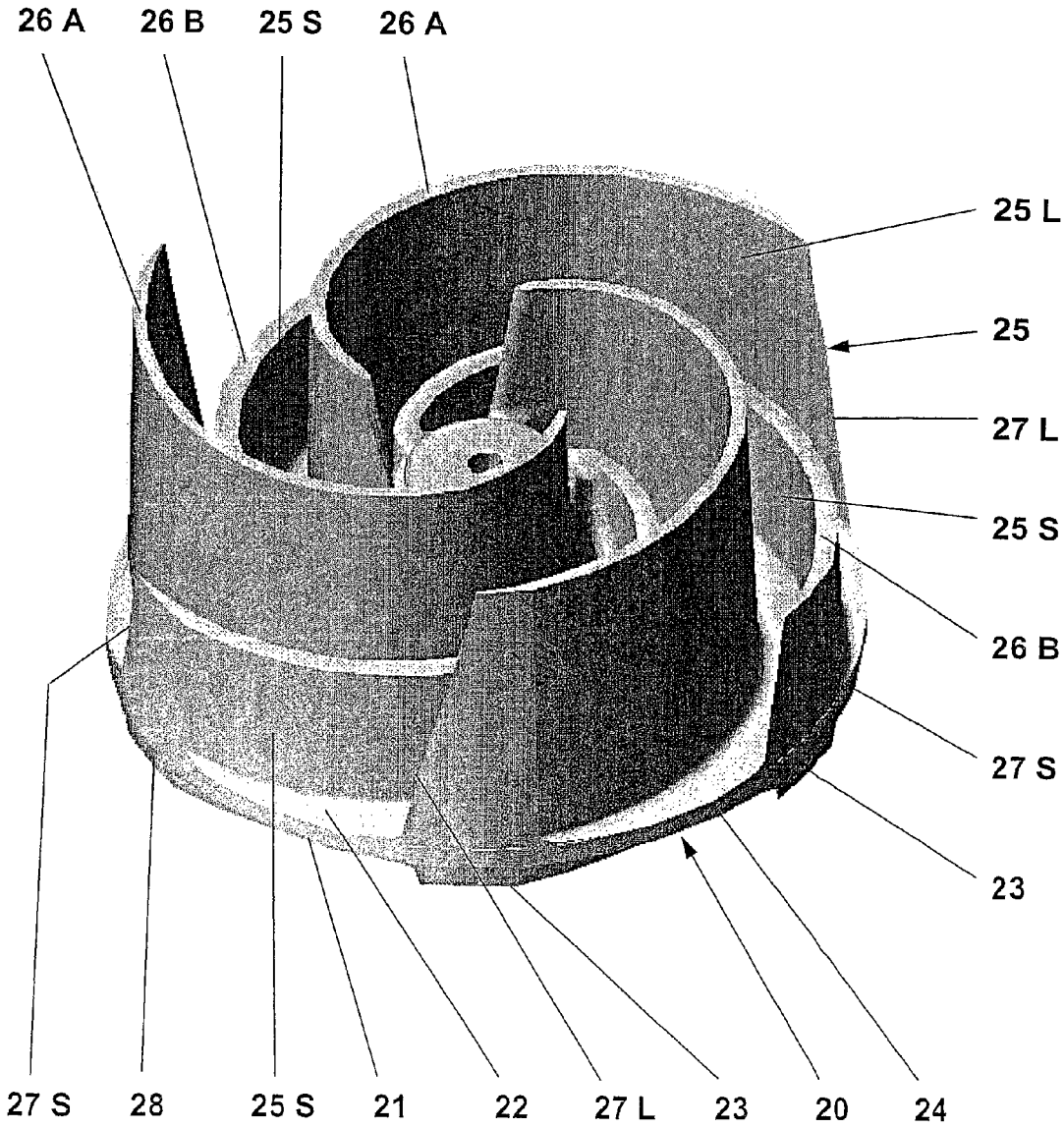
FIG. 3 shows a perspective view of a variant of an impeller having three auxiliary vanes intended for the second embodiment.

As shown in a perspective view in FIG. 3, impeller 20 of this second embodiment may preferably comprise three wide vanes 25L and three narrower auxiliary vanes 25S, auxiliary vanes 25S being each arranged between two respective vanes 25L.

Peripheral surface 24 of impeller plate 21, peripheral edges 27L of wide vanes 25L, and peripheral edges 27S of narrower auxiliary vanes 25S are located on the same non-represented cylindrical or conical or otherwise shaped rotation-symmetrical circumferential surface and are closely encompassed by the rotation-symmetrical casing surface 8, 8A of casing 1 in a similar manner as described in the first embodiment.

Here also (i.e. similarly as in the first embodiment), rearward surface 23 of impeller plate 21 may be located in immediate proximity of surface 9 of rear wall 9A of casing 1, or according to a variant, a larger distance may be provided between these surfaces 23, 9 in order to leave enough space for arranging preferably radially extending ridges 28 (on surface 23) or ridges 29 (on surface 9) on one and/or the other of these surfaces.

Figure 4:
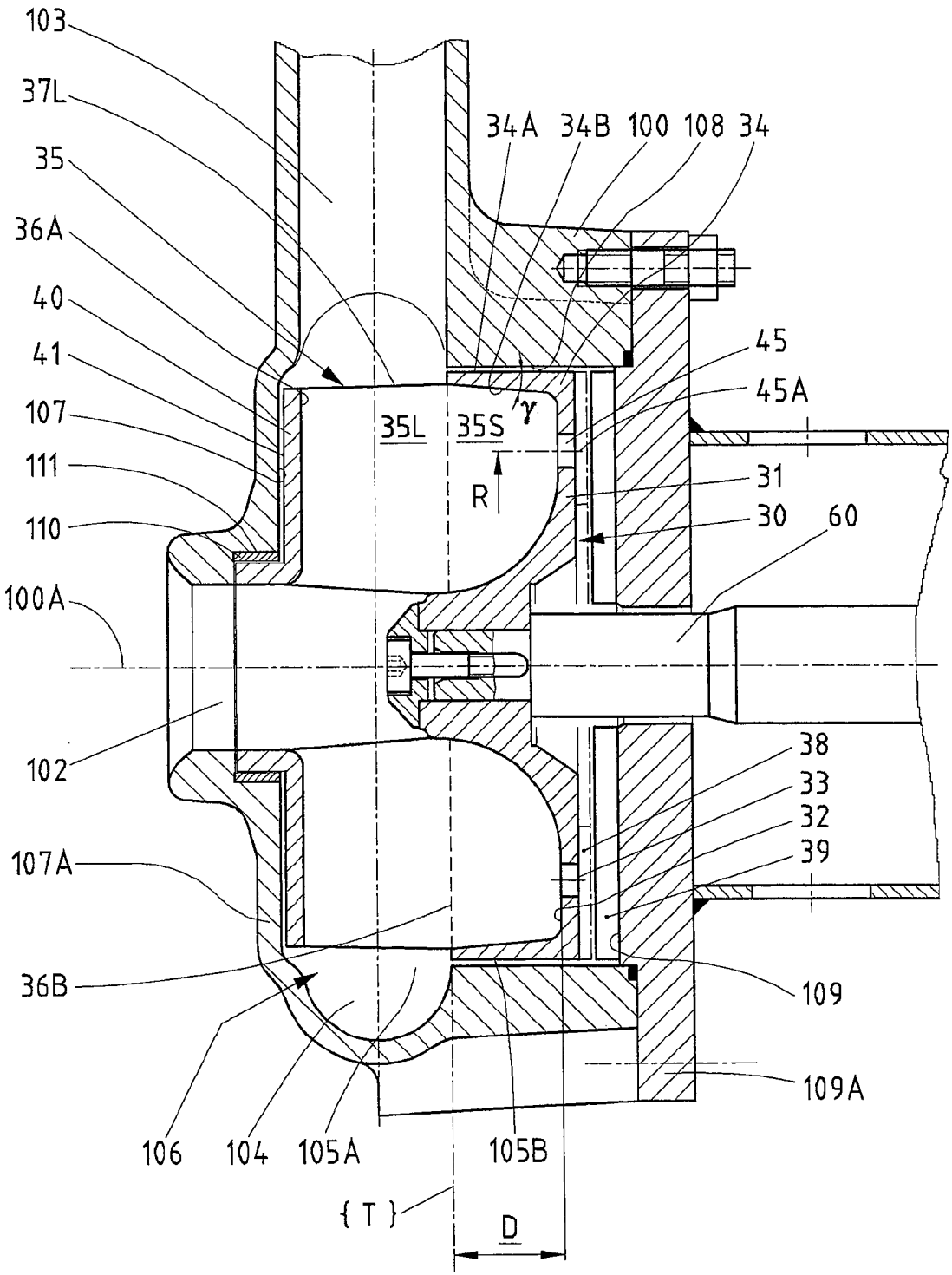
FIG. 4 shows a sectional view of a third embodiment of the pump.

In the third embodiment illustrated in FIG. 4, an impeller 30 having an axis 100A and being connected to shaft 60 is enclosed in a casing 100 having a liquid entrance 102 and exit 103. Casing 100 is similar to casing 1 and includes a forward chamber 105A surrounded by a collecting chamber 104 that is similarly shaped as collecting chamber 4 and a rearward chamber 105B separated therefrom by a virtual plane {T}.

Impeller 30, which is set back by the distance D, has a vane system 35 connected to impeller plate 31 that is comprised of at least one wide vane 35L and at least one narrow auxiliary vane 35S, and preferably, as mentioned with reference to the second embodiment, of three of each. Auxiliary vanes 35S may be similarly shaped as auxiliary vanes 25S, only a forward edge 36B being illustrated here.

Auxiliary vanes 35S and impeller plate 31 are encompassed by an outer ring 34. Inner surface 34B of ring 34 may be conically shaped with a cone angle of $2\gamma$ (where $\gamma$ is preferably $\leqq$20°). Impeller plate 31, ring 34 and auxiliary vanes 35S connected thereto extend within impeller chamber 105B. Peripheral edges 37L, which are movable past liquid exit 103 in relative proximity thereto, may be parallel or inclined with respect to symmetry axis 100A or may be differently shaped.

Forward edges 36A of wide vanes 35L are covered by a cover disk 40. The latter is rotatably supported in a ring 110 that is press-fitted in a sealing gap 111 near entrance 102 of casing 100. Forward surface 41 of cover disk 40 may move in immediate proximity past surface 107 of wall portion 107A. This cover disk, known in the art per se, is often provided for reasons of stability or in pumps having a low specific rotation speed $n_q$.

Similarly as in the first embodiment, rearward surface 33 of impeller plate 31 may be located in immediate proximity of surface 109 of rear wall 109A of casing 100, or according to a variant, a larger distance may be provided between these surfaces 33, 109 in order to leave enough space for arranging preferably radially extending ridges 38 (on surface 33) or ridges 39 (on surface 109) on one and/or the other of these surfaces.

Furthermore, impeller plate 31 may be provided with at least one hole 45. According to the example, three or six bores 45 with axes 45A are arranged between vanes 35L and auxiliary vanes 35S and are correspondingly dimensioned. Axes 45A extend in parallel to axis 101A at a distance R. The measurement of radius R is preferably chosen such as to be comprised in an interval between half and two thirds of the circumferential radius of the impeller plate approximately. It has been found that these holes 45 sensibly improve the efficiency of the outward gas discharge.

It is understood that further preferred embodiments can be realized in which features of the described embodiments are combined. In particular, it is possible to provide impellers 11 and 21 according to the first and the second embodiment with individual or even all additional features of impeller 30 described with reference to FIG. 4, i.e. outer ring 34, bores 45, cover disk 40, or with further features within the knowledge of those skilled in the art.

From the foregoing description, further modifications and variations are apparent to those skilled in the art without leaving the protective scope of the invention as defined by the claims.

The invention claimed is:

1. A centrifugal channel impeller pump for pumping liquids with solid and gaseous admixtures, comprising a casing having a forward lateral liquid entrance, an exit and an impeller chamber between the liquid entrance and the exit; the casing having a wall with an inner surface defining the chamber;

a drivable impeller in the impeller chamber and comprising an impeller plate, at least one vane carried on the plate, and extending in the impeller chamber, the at least one vane having a forward edge which is directed toward the liquid entrance and is at least partly arranged to move in immediate proximity past the inner surface of the casing wall portion that extends around the liquid entrance, the at least one vane has a peripheral edge which extends past the liquid exit as the at least one vane passes the exit, the impeller plate being set back by a defined distance D and the at least one vane is axially enlarged toward the entrance by the distance D, the impeller chamber having a rearward part of the distance D; the impeller chamber comprises a rearward impeller chamber in which the axially enlarged rearward part of the at least one vane extends and also has a forward part that extends axially past the exit from the impeller chamber, the forward and rearward parts are separated by a virtual radial plane and the rearward part has a volume that corresponds to the distance D, in order to improve the gas transport.

2. The centrifugal pump of claim 1, further comprising at least one auxiliary vane carried on the impeller plate.

3. The centrifugal pump according to claim 2, wherein the at least one auxiliary vane has have a center width equal to approx. 25% to approx. 75%, of the center width of the at least one vane.

4. The centrifugal pump according to claim 2, wherein the impeller has three of the vanes and three of the auxiliary vanes.

5. The centrifugal pump according to claim 2, further comprising the impeller plate having a peripheral surface;

a casing around the impeller chamber defining a rotation-symmetrical casing surface of the casing enclosing a peripheral surface of the impeller plate and parts of the peripheral edges of the at least one vane and of the at least one auxiliary vane that extend in the rearward impeller chamber.

6. The centrifugal pump according to claim 5, wherein the rotation-symmetrical casing surface of the casing encloses the at least one vane and the at least one auxiliary vane extending in the rearward impeller chamber is conically shaped with a cone angle of $2\gamma$, where $\gamma$ is smaller than or equal to 20°.

7. The centrifugal pump according to claim 2, further comprising a ring of the impeller plate that encompasses the at least one auxiliary vane.

8. The centrifugal pump according to claim 7, wherein the ring has an external surface enclosed in a rotation-symmetrical casing surface of the casing.

9. The centrifugal pump according to claim 7, wherein the ring has an internal surface which is conical with a cone angle $2\gamma$, where $\gamma$ is smaller than or equal to 20°.

10. The centrifugal pump according to claim 2, wherein the at least one auxiliary vane has a forward edge that is orthogonal to a symmetry axis of the impeller.

11. The centrifugal pump according to claim 2, wherein the at least one auxiliary vane has a forward edge that is outwardly or inwardly rising with respect to a symmetry axis of the impeller.

12. The centrifugal pump according to claim 1, further comprising at least one hole in the impeller plate.

13. The centrifugal pump according to claim 1, wherein the impeller chamber is defined by a casing having a rearward casing wall with an inner surface; the impeller plate having a rearward surface facing the inner surface of the rearward casing wall, the inner surface of the rearward casing wall including a part that is turned toward the rearward surface of the impeller plate;

radially extending first ridges on the part of the rearward casing wall.

14. The centrifugal pump according to claim 13, wherein the first ridges are radially extending.

15. The centrifugal pump according to claim 13, further comprising second ridges on the rearward surface of the impeller plate.

16. The centrifugal pump according to claim 15, wherein the second ridges are radially curved.

17. The centrifugal pump according to claim 1, wherein the impeller includes a forward cover disk.

18. The centrifugal pump according to claim 1, wherein the at least one vane has a peripheral edge that is, which are shaped and positioned to be movable past the liquid exit and in relative proximity thereto and are parallel to or inclined with respect to a symmetry axis or differently shaped.

* * * * *